US006967560B2

(12) United States Patent
Andoh et al.

(10) Patent No.: US 6,967,560 B2
(45) Date of Patent: Nov. 22, 2005

(54) BLADE FUSE

(75) Inventors: Hideki Andoh, Gifu (JP); Iwao Murakami, Gifu (JP)

(73) Assignee: Pacific Engineering Corp., Gifu (JP)

( * ) Notice: Subject to any disclaimer, the term of this patent is extended or adjusted under 35 U.S.C. 154(b) by 164 days.

(21) Appl. No.: 10/432,503

(22) PCT Filed: Nov. 22, 2001

(86) PCT No.: PCT/JP01/10220

§ 371 (c)(1),
(2), (4) Date: Nov. 10, 2003

(87) PCT Pub. No.: WO02/43097

PCT Pub. Date: May 30, 2002

(65) Prior Publication Data

US 2004/0070485 A1 Apr. 15, 2004

(30) Foreign Application Priority Data

Nov. 22, 2000 (JP) ..... 2000-356805

(51) Int. Cl.[7] ..... H01H 85/153; H01H 85/175

(52) U.S. Cl. ..... 337/198; 337/228; 337/251; 337/186; 337/187

(58) Field of Search ..... 337/198, 186, 337/187, 225, 227, 228, 251; 200/61.08; 439/890, 893, 849, 850

(56) References Cited

U.S. PATENT DOCUMENTS 3,775,724 A * 11/1973 Mamrick et al. ..... 337/245
3,909,767 A * 9/1975 Williamson et al. ..... 337/264
4,023,264 A 5/1977 Schmidt, Jr. et al.
4,344,060 A 8/1982 Ciesemier et al. ..... 337/260
4,580,124 A 4/1986 Borzoni
4,604,602 A * 8/1986 Borzoni ..... 337/264
4,661,793 A * 4/1987 Borzoni ..... 337/260
4,670,729 A * 6/1987 Oh ..... 337/262
4,831,353 A 5/1989 Gaia et al.
4,998,086 A * 3/1991 Kourinsky et al. ..... 337/255
5,239,282 A * 8/1993 Filomia ..... 337/255
5,373,278 A * 12/1994 Saulgeot et al. ..... 337/255
5,507,669 A * 4/1996 Jannett et al. ..... 439/621
5,668,521 A * 9/1997 Oh ..... 337/186
5,668,522 A * 9/1997 Kondo et al. ..... 337/198
6,545,585 B2 * 4/2003 Endo et al. ..... 337/260

FOREIGN PATENT DOCUMENTS

DE 86 09 415 U 6/1986 ..... H01H 85/24
DE 299 12 534 U1 11/1999 ..... H02B 1/18
JP 56-2561 1/1981
JP 62-3883 1/1987
JP 1-45174 10/1989

(Continued)

*Primary Examiner*—Anatoly Vortman
(74) *Attorney, Agent, or Firm*—Fish & Richardson P.C.

(57) ABSTRACT

A compact fuse (1) for an automobile is provided. The fuse is formed by a fuse element (2) and an insulative housing (3) having a cutaway portion (8). The fuse element includes two base plates (4) and a melting portion (5) connecting the base plates. The melting portion is accommodated in the housing and parts of the base plates are exposed from the housing. The length of the base plate is the sum of the length (A) of the melting portion in the longitudinal direction of the base plate, the length (B) of a notch (4*c*) in the longitudinal direction of the base plate, and the length (C) of a cover supporting portion in the longitudinal direction of the base plate.

6 Claims, 10 Drawing Sheets

FOREIGN PATENT DOCUMENTS

| | | | | |
|---|---|---|---|---|
| JP | 2-501424 | | 5/1990 | |
| JP | 04123741 | A * | 4/1992 | ..... H01H 73/02 |
| JP | 5-81935 | | 11/1993 | |
| JP | 07-292241 | | 11/1995 | |
| JP | 11-199770 | | 7/1999 | |
| JP | 11-217497 | | 8/1999 | |
| JP | 2001-291464 | | 10/2001 | |
| JP | 2001-325874 | | 11/2001 | |
| RU | 2 154 328 | C2 | 8/2000 | ..... H01R 9/24 |
| SU | 1683091 | A1 | 10/1991 | ..... H01H 85/18 |

* cited by examiner

BLADE FUSE

BACKGROUND OF THE INVENTION

The present invention relates to fuses, and more particularly, to blade fuses for electric circuits installed in automobiles.

Typically, automobiles have fuses that are arranged between a battery and various electric components to protect circuits from excessive current. A prior art fuse is disclosed, for example, in U.S. Pat. No. 4,023,264.

FIG. 15 shows a prior art fuse 50. The fuse 50 includes an insulative fuse housing 54 and a fuse element 53, which is an H-like conductive plate. The fuse element 53 has two parallel flat base plates 51 and a fuse melting portion 52 that connects the two base plates 51. A terminal 51*a* is formed at the distal end of each base plate 51. The terminals 51*a* extend from the fuse housing 54, and portions of the fuse element 53 other than the terminals 51*a* are retained in the fuse housing 54. In other words, in FIG. 15, the terminals 51*a* are portions, which protrude downward from the lower end of the fuse housing 54.

As shown in FIG. 16, a plurality of fuses 50 are connected to a fuse box 55. Referring to FIG. 17, the fuse box 55 has a plurality of bus bars 56 that are connected to the terminals 51*a* of the fuses 50. Each of the bus bars 56 is bent to define a tab 57. As shown in FIG. 18, the distal end of each tab 57 is bifurcated to form two opposing divided contact pieces 57*a*. As shown in FIG. 18, the terminal 51*a* of the fuse 50 is received between the two divided contact pieces 57*a* so that the terminals 51*a* each electrically contact the corresponding tabs 57. In this manner, the fuse 50 is connected to the fuse box 55.

The increase in the number of electric components installed in recent vehicles has increased the number of protection fuses 50, which are used in the vehicles. The fuse box 55 must be relatively large to store many fuses. However, to improve the comfort of a vehicle, the interior of the vehicle is required to be enlarged. The enlargement of the vehicle interior and the installation of a large fuse box 55 are contradicting concepts and it is difficult to satisfy both demands.

With reference to FIGS. 17 and 18, when the prior art fuse 50 is connected to the fuse box 55, the height (L) from the level of the bus bar 56 to the upper end of the fuse 50 is greater than the sum of the length (M) of the tab 57 and the height (N) of the housing 54.

Since the above height (L) relates to the size of the fuse box 55, the structure of the fuse 50 hinders the production of a smaller fuse box 55.

Increasing the voltage of an automobile battery is being considered nowadays. The prior art fuse housing 54 is made of polyethelsulfone. However, in such a fuse housing 54, the required insulative resistance cannot be obtained when performing a fuse standard test with, for example, a 58V fuse. Accordingly, a fuse that is suitable for an increase of the battery voltage in the future is required.

SUMMARY OF THE INVENTION

It is a first object of the present invention to provide a compact fuse for automobiles. It is a second object of the present invention to provide a fuse for automobiles, which is easily assembled. It is a third object of the present invention to provide a fuse for automobiles that is suitable to higher voltage.

To achieve the above object, the present invention provides a blade fuse including a fuse element and a housing made of a insulative material for fixing the fuse element. The fuse element includes two base plates arranged along a common plane, a melting portion connecting the two base plates, a pair of opposing notches arranged on each of the two base plates, and two cover supporting portions extending continuously from the notches, respectively. The housing includes a hollow portion, which accommodates the melting portion, and a cover, which is bent to close the hollow portion. The cover is arranged between the notches. The base plate has a length that is substantially the sum of the length of the melting portion in the longitudinal direction of the base plate, the length of the notch in the longitudinal direction of the base plate, and the length of the cover supporting portion in the longitudinal direction of the base plate.

The base plate includes a first surface and a second surface, which are parallel to the plane, and an outer end surface, which is defined between the first surface and the second surface and it is preferred that at least one of part of the first surface and the second surface and the outer end surface be exposed from the housing and plated.

In one perspective, the insulative material is a translucent resin. It is preferred that the housing be a member integrally formed of a top portion, which has two fitting portions, each receiving one end of the base plates, a melting portion cover, which defines the hollow portion, and a fixing surface, which has a cutaway portion for exposing part of each base plate and extends continuously from the melting portion cover to fix the base plate.

In one perspective, the cutaway portion of the fixing surface includes a slit formed along the longitudinal direction of the base plate.

In one perspective, the housing includes a cutaway portion that exposes the outer end surface of the base plate.

It is preferred that the insulative material be formed from a reinforced polyamide resin, which is made by polymerizing a mixture consisting of 0.2 to 20 parts by weight of fluorine mica minerals and 100 parts by weight of a monomer for forming a polyamide resin.

BRIEF DESCRIPTION OF THE DRAWINGS

FIG. 4(*b*) is a cross-sectional view of the fuse taken along line 4*b*—4*b* in FIG. 3.

DETAILED DESCRIPTION OF THE PREFERRED EMBODIMENTS

Figure 1:
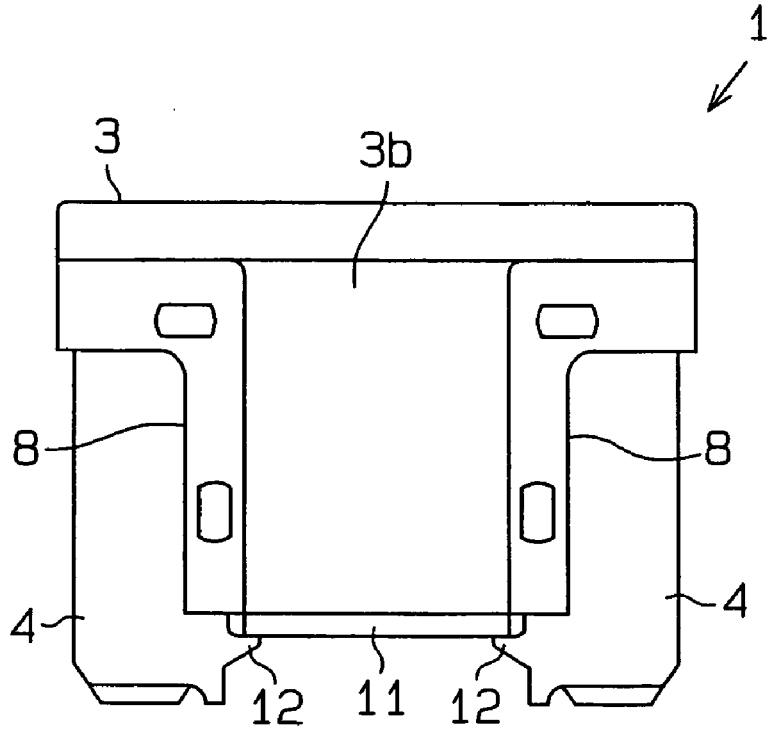
FIG. 1 is a front view showing a fuse according to a first embodiment of the present invention.
Figure 2:
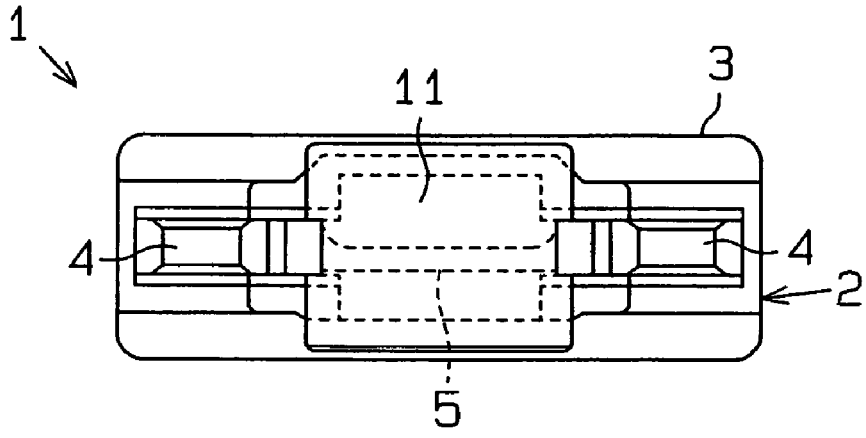
FIG. 2 is a bottom view showing the fuse of FIG. 1.
Figure 3:
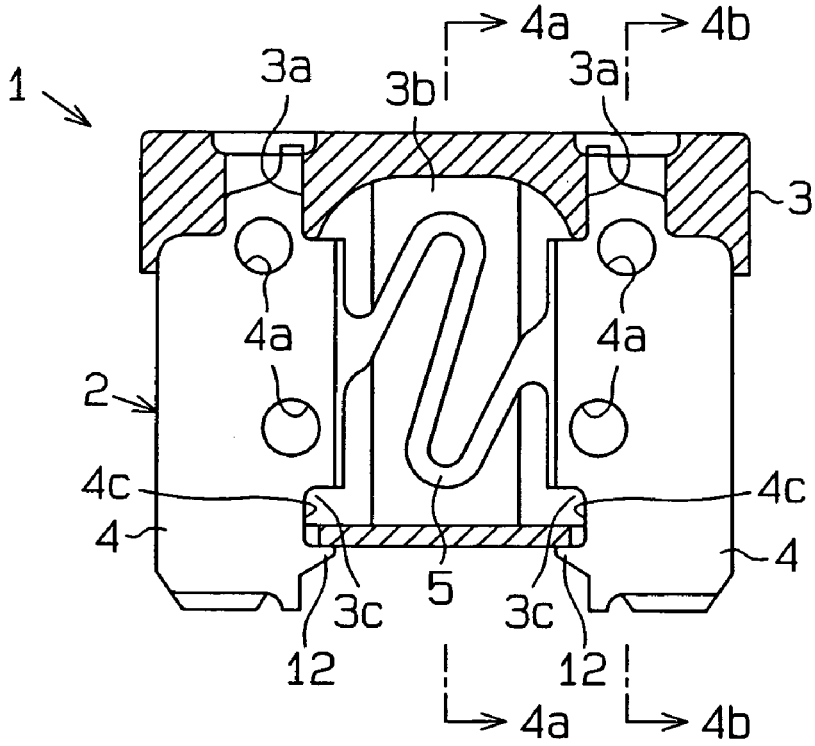
FIG. 3 is a cross-sectional view showing the fuse of FIG. 1.

A fuse 1 according to a first embodiment of the present invention will now be described with reference to drawings. Referring to FIGS. 1 to 4, the fuse 1 includes a fuse element 2 and a housing 3, which is made of an insulative material.

The fuse element 2 includes two base plates 4, which are arranged along a common plane, a melting portion 5, which connects the two base plates 4, two opposing notches 4*c* formed in each of the two base plates 4, and a cover supporting portion, which includes two triangular projections 12 that extend continuously from each of the notches 4*c*. The melting portion 5 is covered by the housing 3, and the base plates 4 are fixed to the housing 3.

Figure 7:
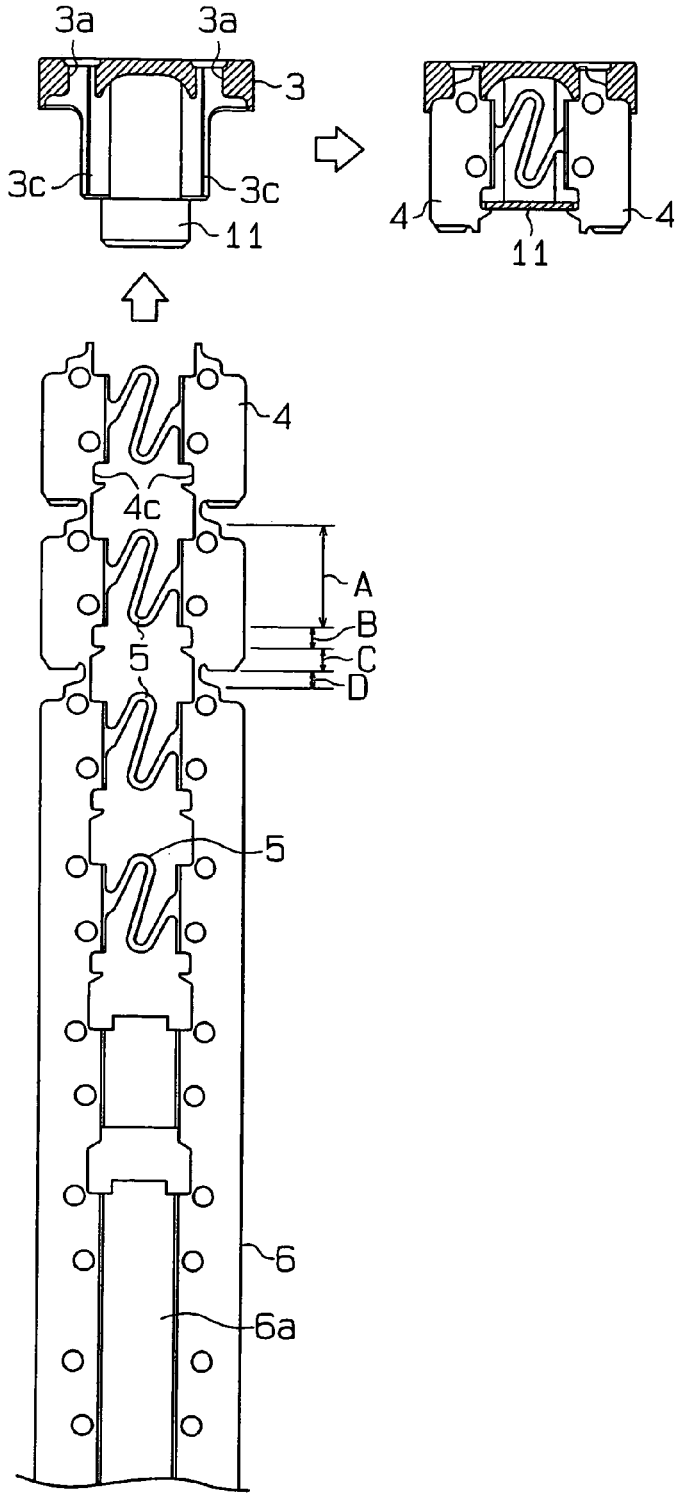
FIG. 7 is a schematic view illustrating a manufacturing method of the fuse according to the first embodiment of the present invention.
Figure 8D:
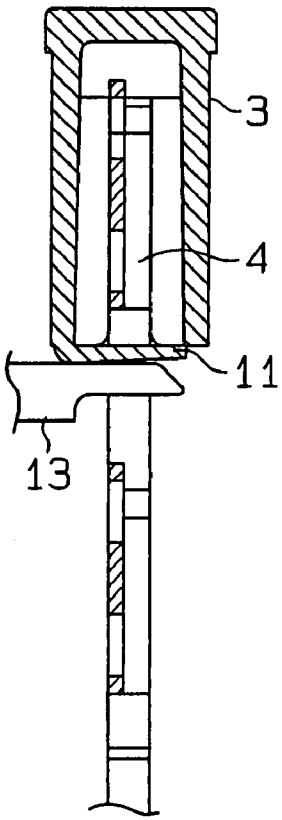
FIGS. 8(*a*) to 8(*d*) are cross-sectional views showing a cover bending process.
Figure 8C:
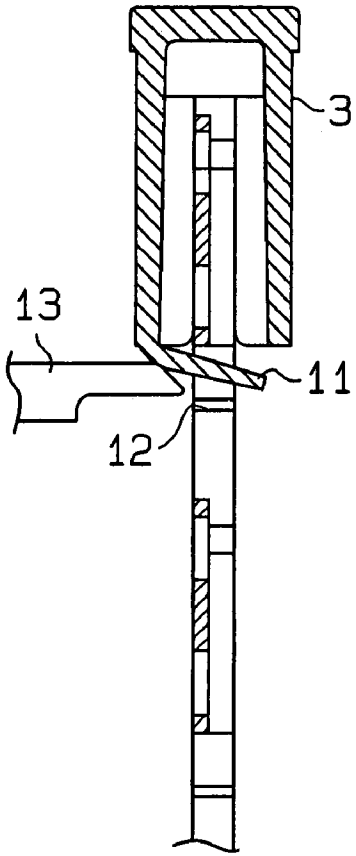
Figure 8B:
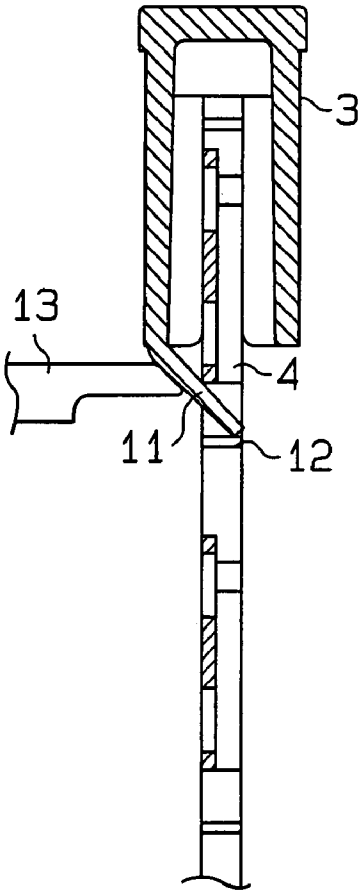
Figure 8A:
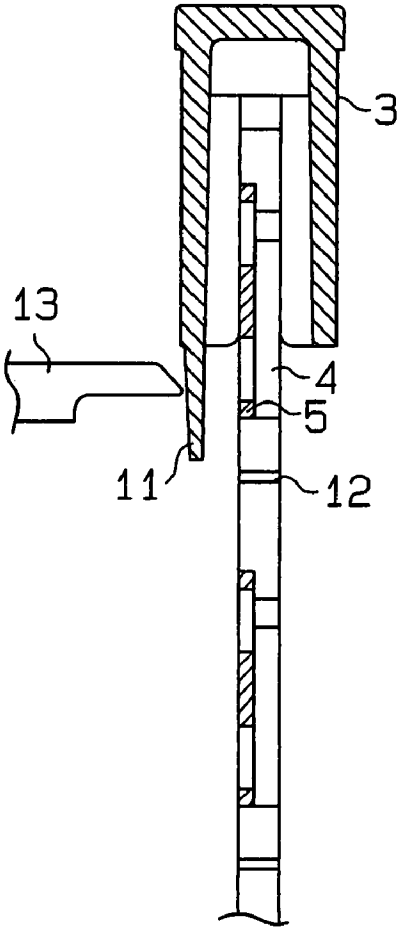
Figure 9:
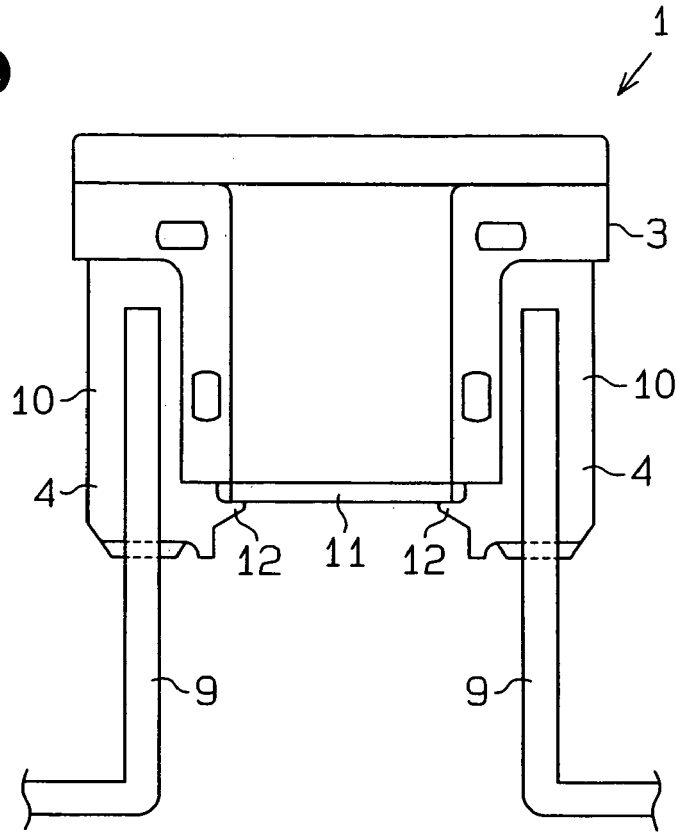
FIG. 9 is a front view showing the fuse of FIG. 1 connected to a bus bar.
Figure 10:
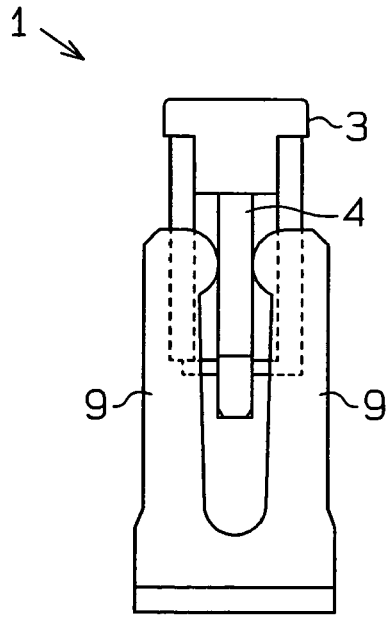
FIG. 10 is a side view showing the fuse of FIG. 1 connected to the bus bar.

Referring to FIG. 7, the length of the base plate 4 is substantially equal to the sum of the length (A) of the melting portion 5 in the longitudinal direction of the base plate 4, the length (B) of the notch 4*c* in the longitudinal direction of the base plate 4, and the length (C) of the cover supporting portion in the longitudinal direction of the base plate 4.

The housing 3 is a flat resin integral product including a hollow portion, which accommodates the melting portion 5, and a cover (flap) 11, which is bent to close the hollow portion. It is preferred that the housing 3 be made of a translucent resin material that is heat resistant and insulative. Fitting portions 3*a*, which receive and fix the upper end of each base plate 4, are defined in the top of the housing 3. Melting portion covers 3*b* are defined at the laterally middle portion of the housing 3. The melting portion covers 3*b*, which are opposed to each other, define the hollow portion that accommodates the melting portion 5. Fixing surfaces 3*c* are defined on the two melting portion covers 3*b* to fix the base plates. The distance between the two melting portion covers 3*b* is greater than the distance between the opposing fixing surfaces 3*c*. The dimension of the top of the housing 3 in the lateral direction is slightly greater than the width of the fuse element 2 in the lateral direction. Part of the base plates 4 is exposed from a cutaway portion 8, which is defined in the fixing surfaces 3*c*. The cover 11 is attached to the lower end of the housing 3. The cover 11, which is bent, is arranged between the two notches 4*c* of the base plates 4.

Figure 5:
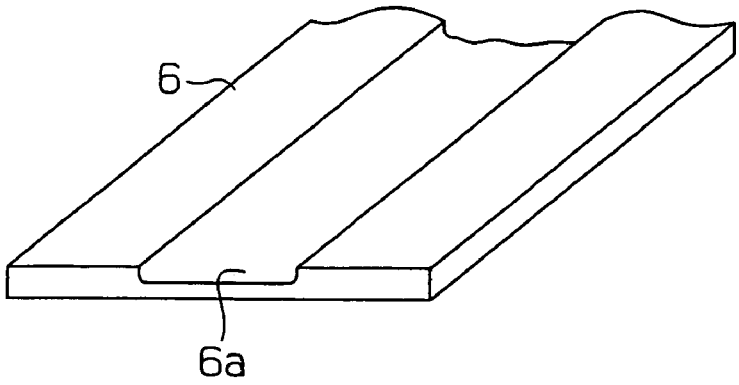
FIG. 5 is a partial perspective view showing a fuse material.
Figure 6:
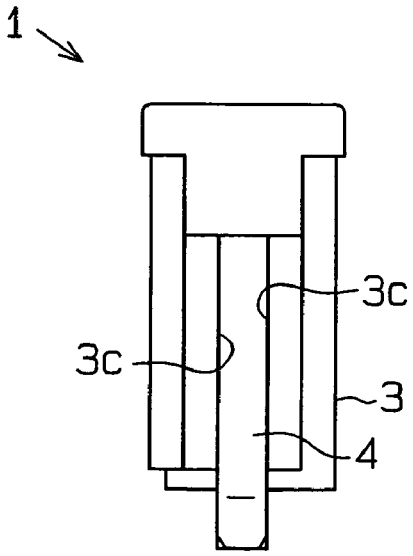
FIG. 6 is a side view showing the fuse of FIG. 1.

The fuse element 2 is formed from an elongated sheet of fuse material plate 6 shown in FIG. 5. It is preferred that the fuse material plate 6 be made of a zinc (Zn) alloy conductive plate.

The fuse 1 is manufactured as described below.

First, the laterally middle portion of the fuse material plate 6 is cut to form a thin portion 6*a* having a predetermined width in the longitudinal direction.

Referring to FIG. 7, a unit including a plurality of fuse elements 2 is pressed out while intermittently moving the fuse material plate 6. More specifically, the melting portions 5 corresponding to the fuse current capacity of the fuse are pressed out of the thin portion 6*a*, and the two base plates 4 are pressed out on each side of the melting portions 5. Each of the base plates 4 has the notch 4*c*, the cover supporting portion, which includes the triangular projections 12 continuously extending from the notches 4*c*, and a fastening hole 4*a* used for crimping.

Each fuse element 2 of the unit has a length that corresponds to the sum of the length (A) of the melting portion 5, the length (B) of the notch 4*c*, the length (c) of the cover supporting portion (c), and the length (D) of a connection portion arranged between adjacent fuse elements 2 for continuous production. Thus, the length of the fuse element 2 is such that the fuse element 2 is easy to use, has high productivity, and has the minimal length required to form the desired structure.

Figure 4A:
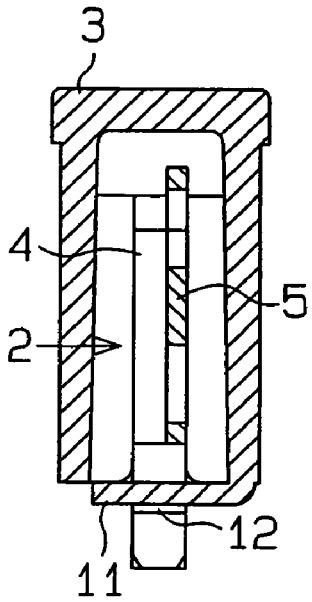
FIG. 4(*a*) is a cross-sectional view of the fuse taken along line 4*a*—4*a* in FIG. 3.
Figure 4B:
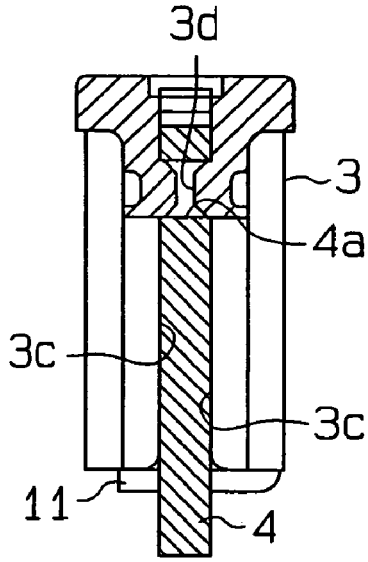

Subsequently, a fuse element 2 at the distal end of the unit is attached to the housing 3. More specifically, the top end of the fuse element 2 and the middle portion of the base plate 4 in the longitudinal direction are inserted in the housing 3. Referring to FIG. 4*b*, the base plates 4 are pressed into the space between the opposing fixing surfaces 3*c*. This engages engaging projections 3*d* with the fastening holes 4*a* to fasten the fuse element 2 to the housing 3.

Part of the base plate 4 is exposed from the cutaway portions 8, which is arranged in the housing 3, to come into contact with contact terminals arranged in a fuse box (not shown).

Figure 11:
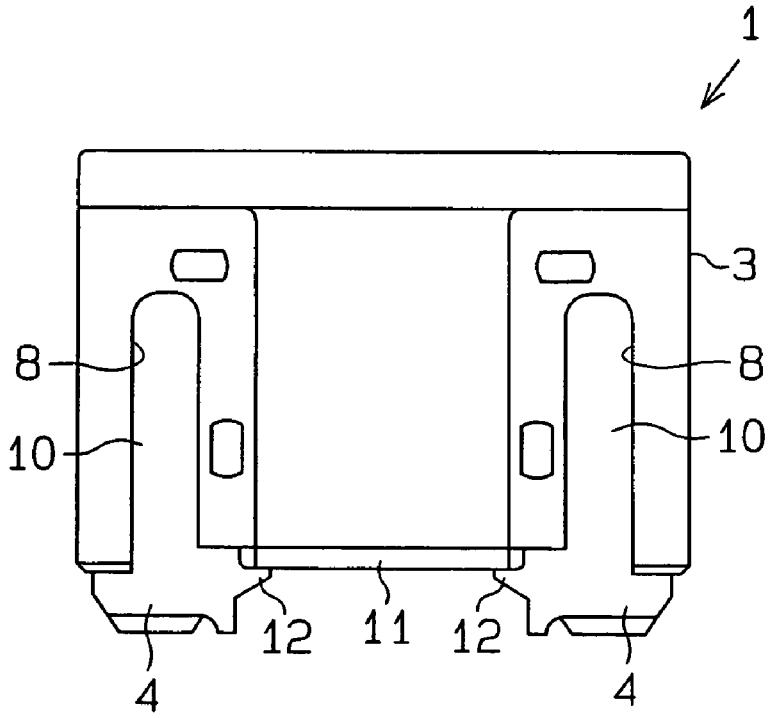
FIG. 11 is a front view showing a fuse according to a second embodiment of the present invention.
Figure 12:
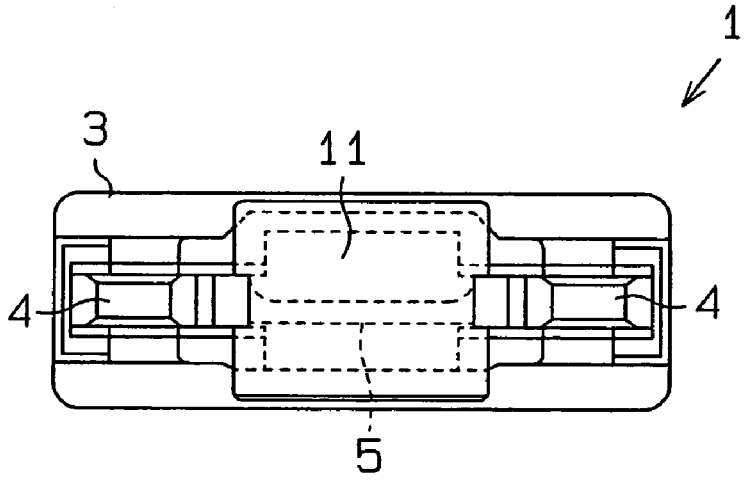
FIG. 12 is a bottom view showing the fuse of FIG. 11
Figure 13A:
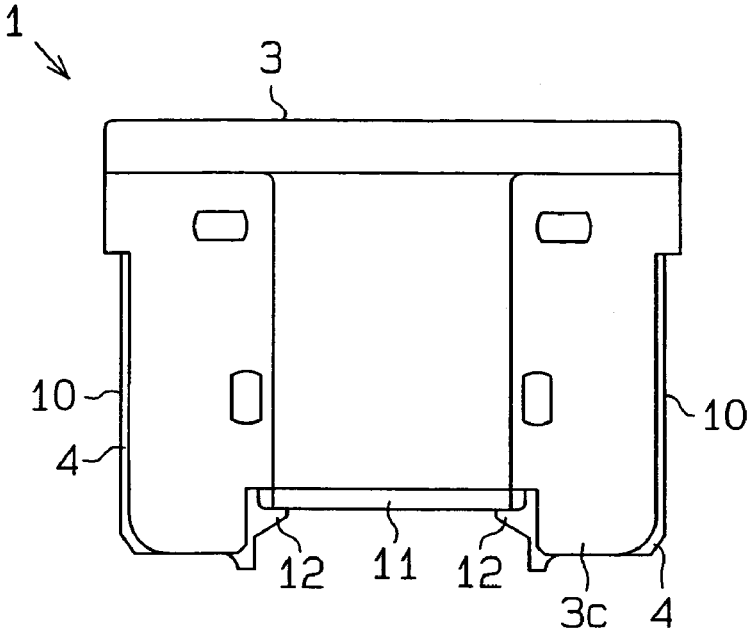
FIG. 13*a* is a front view showing the fuse according to the second embodiment of the present invention.
Figure 13B:
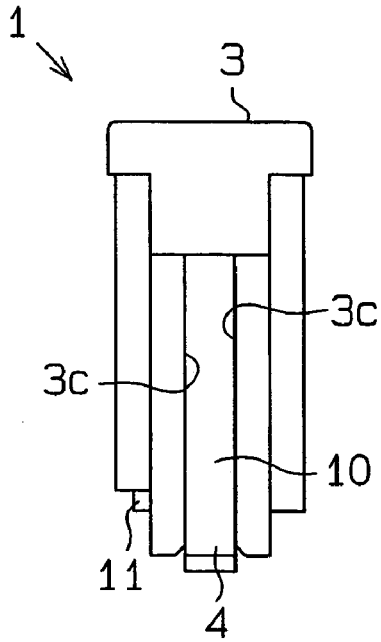
FIG. 13*b* is a side view showing the fuse of FIG. 13*a*.
Figure 14:
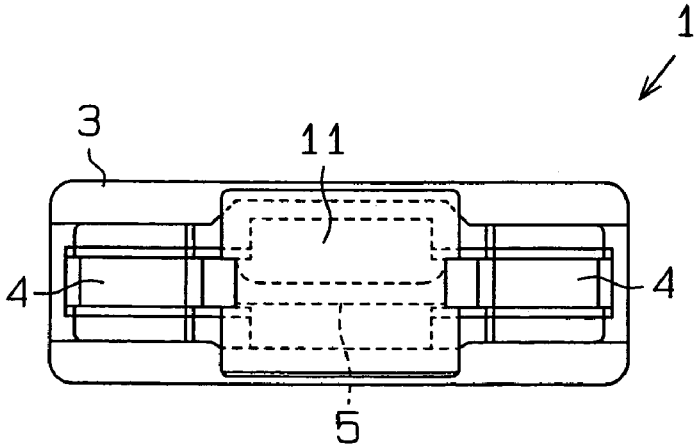
FIG. 14 is a bottom view showing the fuse of FIG. 13*a*.
Figure 15:
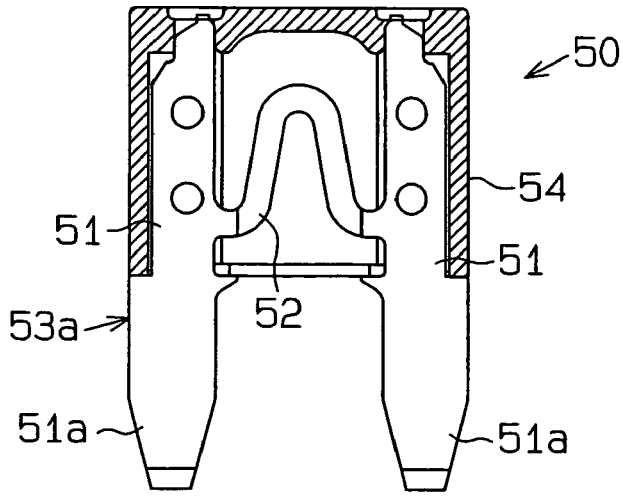
Fig.15 PRIOR ART
FIG. 15 is a cross-sectional view showing a prior art fuse.
Figure 16:
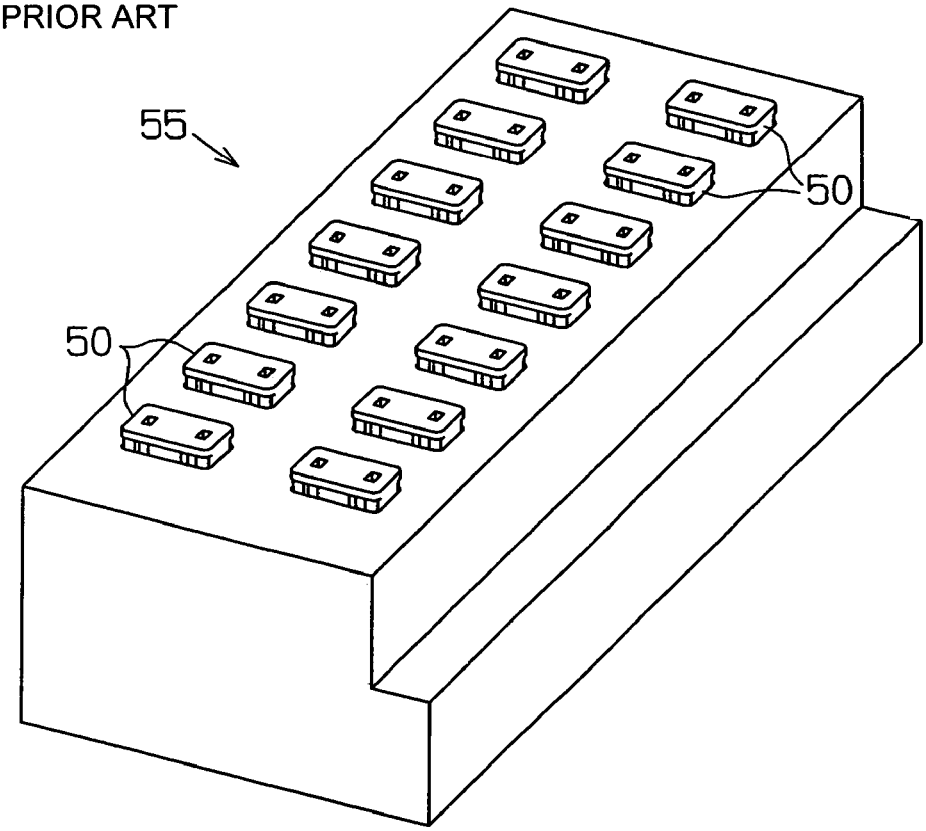
Fig.16 PRIOR ART
FIG. 16 is a perspective view showing prior art fuses connected to a prior art fuse box.
Figure 17:
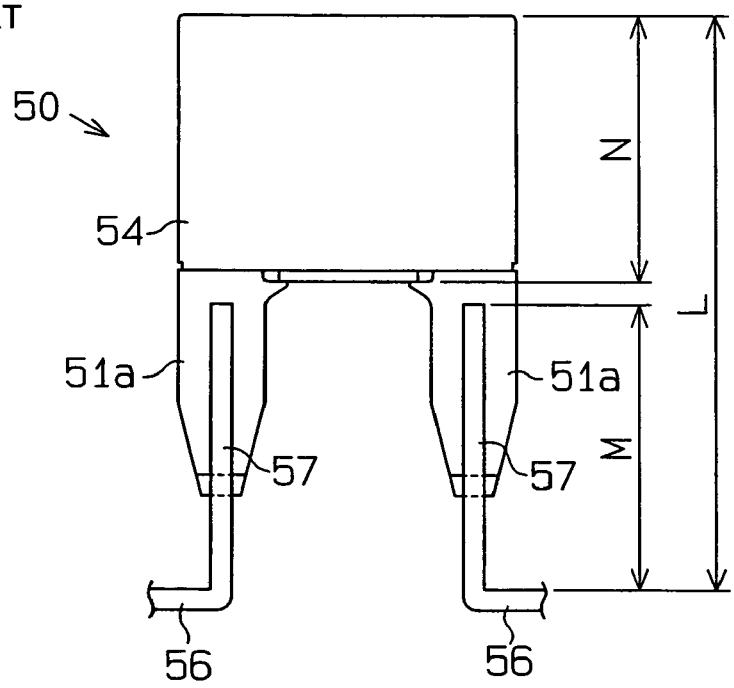
Fig.17 PRIOR ART
FIG. 17 is a front view showing the prior art fuse connected to bus bars.
Figure 18:
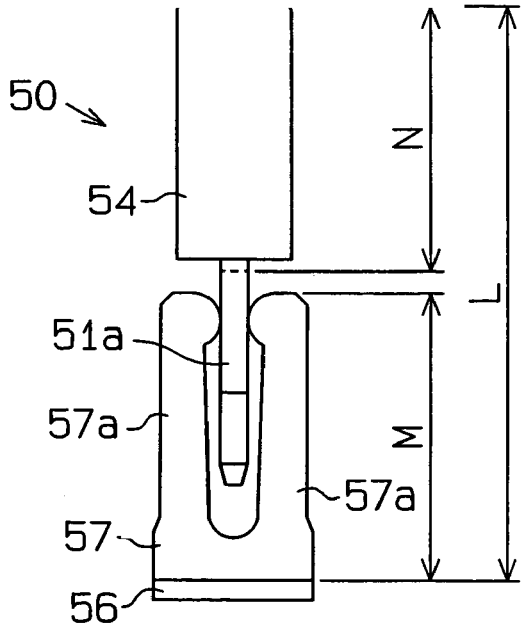
Fig.18 PRIOR ART
FIG. 18 is a side view showing the fuse of FIG. 17.

FIGS. 11 and 12 show a fuse 1 of a second embodiment, and FIGS. 13(*a*), 13(*b*), and 14 show a fuse 1 of a third embodiment. The fuse 1 of the second embodiment is suitable if the corresponding contact terminal is bifurcated, and slit-like cutaway portions 8, which define openings 10 of the base plates 4, are formed in the housing 3. In the fuse 1 of the third embodiment, openings 10 of the base plates 4 are formed on two side surfaces of the fuse element 2 and the fuse 1 is suitable if a contact terminal is a tongue-like terminal that comes into contact with the two side surfaces of the fuse element 2.

It is preferred that the base plate 4 be plated to provide satisfactory electric connection with the contact terminal 9. It is preferred that at least surfaces of the base plate, which come into contact with the contact terminal 9, be plated. In the fuse 1 of FIG. 1, a front surface (a first surface), a rear surface (a second surface), a right end surface, and a left end surface of the fuse element 2, which are exposed from the cutaway portions 8, are, for example, plated. In the fuse 1 of FIG. 11, the openings 10 exposed from the slit-like cutaway portions 8 are plated. In the fuse 1 of FIG. 13, a right end surface and a left end surface of the fuse element 2 are plated. In the fuse 1 of the present invention, the base plate 4, which is not used as a terminal in the prior art, serves as a contact terminal. Thus, plating of the base plate 4, such as tin plating, is necessary. Although the base plates 4 are plated with tin plating in the present embodiments, the base plates may be plated with copper plating or silver plating.

Recent vehicles use more electric components and larger electric components. This has increased the amount of power used by the entire vehicle. Accordingly, research is being conducted to increase the vehicle voltage. For example, in a 42V system, 58V is required as the transient voltage (rush voltage). When the fuse is melted by the transient voltage, a large arc is produced. Thus, it is preferred that the housing 3 be formed from a reinforced polyamide resin, which has sufficient electric insulation and prevents the inner surfaces of the housing 3 from being damaged by an arc. It is preferred that the reinforced polyamide resin be made by polymerizing a mixture consisting of 0.2 to 20 parts by weight of fluorine mica minerals and 100 parts by weight of a monomer for forming a polyamide resin. It is preferred that the housing 3 be integrally formed by such a reinforced polyamide resin.

After the fuse element 2 is inserted, the cover 11 is bent to close the hollow portion.

The bending procedure for the cover 11 will now be discussed.

The cover 11 is bent when the fuse element 2 is inserted in the housing 3. More specifically, as shown in FIGS. 8(*a*) to 8(*d*), when the fuse element 2 is inserted in the housing 3, a bending tool 13 is actuated after the distal end of the cover 11 passes by the distal end of the melting portion 5 and before the distal end of the cover 11 reaches the triangular projections 12. The bending tool 13 slides into a gap defined by the triangular projections 12 and the melting portion 5 such that the cover 11 is located between the notches 4*c*. The projections 12 serve to prevent the cover 11 from opening. In this manner, the cover 11 is bent to close the hollow portion of the housing 3.

When the fuse element 2 is completely inserted in the housing 3, the engaging projections 3*d* of the housing 3 are in engagement with the fastening holes 4*a* and outer surfaces of the housing 3 are cold-crimped. In this manner, the fuse element 2 is fixed to the housing 3.

The fuse 1 of the present invention has the following advantages.

In the present invention, the fuse element 2 having the two base plates 4 and the melting portion 5 is pressed out by intermittently moving a sheet of the elongated fuse material plate 6, which includes the thin portion 6*a* having a predetermined width. Accordingly, the fuse 1 is manufactured efficiently.

The fuse 1 of the present invention differs from the prior art fuses in that the opening 10, which has substantially the same size as that of the housing 3, serves as a contact terminal without projecting downward from the housing 3. This reduces the height of the fuse 1 compared with the prior art fuse 50.

Since the fuse 1 is smaller, the height of a fuse box, in which the fuses are installed, is lowered.

In the fuse 1 of the present invention, the housing 3 is made of a translucent polyamide resin material. This guarantees sufficient insulation even after the melting portion 5 is melted. Thus, in addition to the conventional 14V generation (12V storage) system, the fuse 1 of the present invention may be used in a high-voltage system, such as a 42V system.

Since the fuse element 2 is relatively small and the housing 3 is made of a single member, material cost of the fuse 1 is reduced. Further, a process for assembling separate housing parts is omitted. Thus, assembling cost and time is reduced.

In the fuse 1 of the present invention, most of the terminal does not project from the lower part of the housing 3, and the height of the element, which is stored in the housing 3, is minimized. Accordingly, the height of the fuse 1 is minimized.

The melting portion 5 is accommodated in the hollow portion of the housing 3, which is made of insulative resin. This prevents the melting portion 5, which is melted, from being diffused.

In the fuse 1 of the present invention, the opening (terminal) 10, which is exposed from the cutaway portion 8 of the housing 3, is plated with tin. Accordingly, the fuse 1 comes into contact with the contact terminal 9 in a satisfactory state.

The housing 3 is generally flat box-like translucent resin molded product and has an insertion opening, which receives the element 2, on its lower surface. Further, the cover 11 is bent to close the hollow portion. The melting portion cover 3*b*, which faces the melting portion 5, is curved outward to increase the space of the hollow portion. This efficiently absorbs energy when the melting portion 5 is melted.

The cutaway portion 8 of the housing 3 guarantees that part of the base plate contacts the contact terminal 9.

The present invention provides a vehicle fuse that is compact, easy to assemble, and suitable for higher voltages.

What is claim is:

1. A blade fuse comprising:

a fuse element having two base plates arranged along a common plane, a melting portion connecting the two base plates, a pair of opposing notches arranged on each of the two base plates, and a cover supporting portion extending continuously from each notch; and a housing uniformly made of a insulative material for fixing the fuse element, the housing including a hollow portion, which accommodates the melting portion, a cutaway portion for exposing at least part of each base plate, and a cover, which is bent to close the hollow portion, the cover being arranged between the notches and being supported by the cover supporting portions, and the base plate having a length that is substantially the sum of the length of the melting portion in the longitudinal direction of the base plate, the length of the notch in the longitudinal direction of the base plate, and the length of the cover supporting portion in the longitudinal direction of the base plate.

2. The blade fuse according to claim 1, wherein the base plate includes a first surface and a second surface, which are parallel to the plane, and an outer end surface, which is defined between the first surface and the second surface, wherein at least one of part of the first surface and the second surface and the outer end surface is exposed from the cutaway portion of the housing and plated.

3. The blade fuse according to claim 1, wherein the insulative material is a translucent resin, and the housing is a member integrally formed of a top portion, which has two fitting portions, each receiving one end of the base plates, a melting portion cover, which defines the hollow portion, and a fixing surface, which extends continuously from the melting portion cover to fix the base plate.

4. The blade fuse according to claim 3, wherein the cutaway portion includes a slit formed along the longitudinal direction of the base plate.

5. The blade fuse according to claim 3, wherein the outer end surface of the base plate is exposed from the cutaway portion.

6. The blade fuse according to claim 1, wherein the insulative material is a reinforced polyamide resin, the reinforced polyamide resin being made by polymerizing a mixture consisting of 0.2 to 20 parts by weight of fluorine mica minerals and 100 parts by weight of a monomer for forming a polyamide resin.

* * * * *